US009731298B2

(12) United States Patent
Tsutsumi et al.

(10) Patent No.: US 9,731,298 B2
(45) Date of Patent: Aug. 15, 2017

(54) CONTROL DEVICE OF COAL PULVERIZER

(75) Inventors: Takanori Tsutsumi, Nagasaki (JP); Shigehide Komada, Nagasaki (JP); Masahiko Taniguchi, Nagasaki (JP); Shinji Matsumoto, Nagasaki (JP); Koutaro Fujimura, Nagasaki (JP); Yasuhiro Sueoka, Nagasaki (JP); Isao Moriyama, Nagasaki (JP)

(73) Assignee: MITSUBISHI HATACHI POWER SYSTEMS, LTD., Tokyo (JP)

( * ) Notice: Subject to any disclaimer, the term of this patent is extended or adjusted under 35 U.S.C. 154(b) by 1233 days.

(21) Appl. No.: 12/865,484

(22) PCT Filed: Oct. 15, 2009

(86) PCT No.: PCT/JP2009/067827

§ 371 (c)(1),
(2), (4) Date: Sep. 21, 2010

(87) PCT Pub. No.: WO2010/050364

PCT Pub. Date: May 6, 2010

(65) Prior Publication Data

US 2010/0326337 A1 Dec. 30, 2010

(30) Foreign Application Priority Data

Oct. 31, 2008 (JP) ..... 2008-281099

(51) Int. Cl.
*F23N 5/18* (2006.01)
*B02C 25/00* (2006.01)
*B02C 15/00* (2006.01)

(52) U.S. Cl.
CPC ..... *B02C 25/00* (2013.01); *B02C 15/00* (2013.01); *F23K 2201/10* (2013.01); *F23N 2039/02* (2013.01)

(58) Field of Classification Search
USPC ..... 110/185; 241/34, 33, 36
See application file for complete search history.

(56) References Cited

U.S. PATENT DOCUMENTS 3,467,036 A * 9/1969 Carlos, Jr. ..... 110/106
4,177,950 A * 12/1979 Smith ..... 241/33
(Continued)

FOREIGN PATENT DOCUMENTS

GB 2 431 737 A 5/2007
JP 6-238184 A 8/1994
(Continued)

OTHER PUBLICATIONS

Babcock & Wilcox, Roll Wheel Pulverizer.*
(Continued)

*Primary Examiner* — Jason Lau
(74) *Attorney, Agent, or Firm* — Westerman, Hattori, Daniels & Adrian, LLP

(57) ABSTRACT

There is provided a control device of a coal pulverizer which enables estimation of a coal output with a precision suited for a purpose. In a control device of a coal pulverizer which pulverizes coal by the coal pulverizer and estimates coal output by which the pulverized coal is output to a boiler, the control device includes a main operation circuit which calculates a command signal associated with a coal feed rate on the basis of detection data from a boiler or a power generator connected to the boiler, and an additional control unit which calculates the deviation between a standard coal output pattern preset in the coal pulverizer, and a current coal output pattern, and adds a calculation result by the additional control unit to the main operation circuit as a correction signal.

10 Claims, 9 Drawing Sheets

(56) References Cited

U.S. PATENT DOCUMENTS

| | | | | | |
|---|---|---|---|---|---|
| 4,382,558 | A * | 5/1983 | Svensson | 241/30 |
| 4,485,974 | A * | 12/1984 | Lass | 241/30 |
| 4,518,123 | A * | 5/1985 | Tanaka et al. | 241/18 |
| 4,528,918 | A * | 7/1985 | Sato et al. | 110/347 |
| 4,540,129 | A * | 9/1985 | Zadiraka | 241/34 |
| 5,048,761 | A * | 9/1991 | Kim | 241/19 |
| 5,315,939 | A | 5/1994 | Rini et al. | |
| 5,386,945 | A * | 2/1995 | Nose et al. | 241/30 |
| 5,406,817 | A * | 4/1995 | Takakura et al. | 72/14.4 |
| 5,611,494 | A * | 3/1997 | Williams | 241/27 |
| 5,784,974 | A * | 7/1998 | Krauss | 110/186 |
| 6,467,707 | B1 * | 10/2002 | Williams, Jr. | 241/18 |
| 2003/0024293 | A1 * | 2/2003 | Yamamoto et al. | 72/245 |
| 2007/0100502 | A1 * | 5/2007 | Rennie et al. | 700/266 |
| 2008/0230637 | A1 * | 9/2008 | Havlena et al. | 241/25 |

FOREIGN PATENT DOCUMENTS

| | | | |
|---|---|---|---|
| JP | 8-243429 | A | 9/1996 |
| JP | 08-243429 | A | 9/1996 |
| JP | 9-178158 | A | 7/1997 |
| JP | 10-337494 | A | 12/1998 |
| JP | 2000-171028 | A | 6/2000 |
| JP | 3746528 | B2 | 2/2006 |
| JP | 3785088 | B2 | 6/2006 |
| JP | 2008-243429 | A | 10/2008 |
| JP | 4245574 | B2 | 3/2009 |
| RU | 2 123 636 | C1 | 12/1998 |
| RU | 87 700 | U1 | 10/2009 |
| SU | 1440537 | A1 | 11/1988 |
| SU | 1595567 | A1 | 9/1990 |

OTHER PUBLICATIONS

International Search Report of PCT/JP2009/067827, mailing date of Jan. 12, 2010.

Notification of Transmittal of Copies of Translation of the International Preliminary Report on Patentability (Form PCT/IB/338) of International Application No. PCT/JP2009/067827 mailed May 12, 2011 with forms PCT/IB/373 and PCT/ISA/237.

Russian Decision to Grant dated Mar. 10, 2012, issued in corresponding Russian Patent Application No. 2010136274, (8 pages). W/ English Translation.

Chinese Office Action dated Jan. 28, 2013, issued in corresponding Chinese Patent Application No. 200980105540.3, with English translation (10 pages).

Notice of Allowance dated Jan. 15, 2013, issued in corresponding Australian Patent Application No. 2009311030.

Notice of Allowance dated Aug. 14, 2012, issued in corresponding Japanese Application No. 2008-281099, w/ English translation.

Notice of Allowance dated Jul. 27, 2012, issued in corresponding Taiwanese Application No. 098136161, w/English translation.

Mexican Notice of Allowance dated Sep. 24, 2013, issued in the corresponding Mexican patent application No. MX/a/2010/009409.

European Decision to grant a European patent dated Aug. 16, 2013, issued in corresponding European Patent Application No. 09823477.6.

Chinese Notice of Allowance dated Aug. 27, 2013, issued in corresponding Chinese Patent Application No. 200980105540.3, w/ English translation.

Vietnamese Notice of Allowance dated Aug. 26, 2014, issued in corresponding Vietnamese Patent Application No. 1-2010-02261, (1 page).

The Notice of Acceptance effective Nov. 3, 2014, issued to the corresponding Chilean Application No. 2010-000919 (1 page).

* cited by examiner

CONTROL DEVICE OF COAL PULVERIZER

TECHNICAL FIELD

The present invention relates to a control device of a coal pulverizer which feeds a pulverized fuel, which is obtained by pulverizing a solid fuel to fine powder, to a boiler along with carrying air.

BACKGROUND ART

Generally, in a boiler using various kinds of coal as fuel, because coal properties, such as indexes indicating the hardness of coal, such as a Hardgrove grindability index (HGI) and moisture percentage, are different, the grindability and transportability in a mill are significantly different. When the feed rate of coal from a coal feeder to the mill is changed for the load fluctuation of the boiler, since coal properties are different, the delay of the coal output from the mill is different depending on the each type of coal. This becomes a disturbance in the control of the steam temperature or, steam pressure in the boiler.

As a method of optimizing the operation of such a boiler, for example, Patent Document 1 (Japanese Patent No. 3746528) discloses a configuration which includes first estimation means which calculates an absorbed heat quantity estimate of a furnace, and second estimation means which calculates an absorbed heat quantity estimate of a final reheater, and which grasps burning characteristics of the boiler on the basis of the ratio of the absorbed heat quantity estimate of the furnace and the absorbed heat quantity estimate of the final reheater. Additionally, Patent Document 2 (Japanese Patent No. 3785088) discloses a configuration adapted to calculate a reference value in the rotation frequency of a rotary classifier according to the feed rate of coal supplied to a coal pulverizer (mill) annexed to a boiler, to add to the reference value a first correction coefficient obtained by normalizing the influence exerted on the control of the rotation frequency and a second correction coefficient obtained from a hardness index value of coal estimated during the operation of the boiler, and to perform the control of the rotation frequency of the rotary classifier on the basis of the output rotation frequency.

Here, a specific example of a conventional control system will be shown below. FIG. 7 is a block diagram illustrating the configuration of a control device including a circuit which calculates a mill coal feed rate command. As shown in this drawing, FX1, FX2, and FX3 are function generators, and preceding signals based on a power generator output command value are input to a changeover switch T. In the changeover switch T, a selection destination is automatically or manually changed over depending on an absorbed heat ratio or an absorbed heat ratio estimation signal. An imperfect differential circuit outputs a so-called boiler acceleration signal (BIR), and a selection destination of this signal is also changed over depending on an absorbed heat ratio by the changeover switch T. Three imperfect differential circuits have different gains, time constants, etc. FIG. 7 shows a case of a circulation boiler, and a drum pressure deviation is input to the control system. The control system is, for example, a PID controller, etc. In the case of a through flow boiler, a main steam temperature deviation is changed to the drum pressure deviation, and input to the control system.

On the basis of a mill coal output command calculated here, the control signal of a mill is calculated by a control device shown in FIG. 8. FIG. 8 is a block diagram illustrating the configuration of a conventional control device including a circuit which calculates an MRS rotation frequency command. In this drawing, FX11 is a function generator which gives a preceding signal based on a mill coal feed rate command value. FX12 is a function generator which gives a standard mill current with respect to the mill coal feed rate command value. In the case of coal which is hard to be pulverized, becomes greater than the standard mill current. A deviation is input to a controller. In this case, the controller is, for example, a proportional controller. The sum of the preceding signal and an output signal of the control system becomes an MRS rotation frequency command signal.

Additionally, as another example, FIG. 9 is a block diagram illustrating the configuration of a conventional control device including a circuit which calculates a mill pressurizing device oil pressure setting value. FX21 is a function generator which gives a preceding signal based on a mill coal feed rate command value. FX22 is a function generator which gives a mill roll lift with respect to the mill coal feed rate command value. A deviation is input to a controller. In this case, the controller is, for example, a proportional controller, etc. The sum of the preceding signal and an output signal of the control system becomes a mill pressurizing device oil pressure setting signal.

As described above, since coal properties, such as HGI and moisture percentage, are different in the case of many kinds of coal, the grindability and transportability in a coal pulverizer are significantly different. Additionally, when the coal feed rate was changed for the load fluctuation of a boiler, the delay of coal output from the coal pulverizer became a disturbance in the steam temperature or steam pressure control of the boiler, and stable control could not be performed. Additionally, even in the same kind of coal, HGI and moisture percentage had considerable variations and the same state was observed. Additionally, conventionally, since the control according to the properties of coal could not be performed in real time, stable operation of the boiler was difficult.

[Patent Document 1] Japanese Patent No. 3746528
[Patent Document 2] Japanese Patent No. 3785088

SUMMARY OF THE INVENTION

Problems to be Solved by the Invention

Accordingly, the object of the invention is to provide a control device of a coal pulverizer which enables estimation of a coal output with a precision suited for a purpose in view of the problems of the above conventional technique.

Means for Solving the Problems

Thus, in order to solve such problems, the invention provides a control device of a coal pulverizer which pulverizes coal by the coal pulverizer and estimates coal output by which the pulverized coal is output to a boiler.

The control device includes a main operation circuit which calculates a command signal associated with a coal feed rate on the basis of detection data from a boiler or a power generator connected to the boiler, and an additional control unit which calculates the deviation between a standard coal output pattern preset in the coal pulverizer, and a current coal output pattern, and is adapted to add a calculation result by the additional control unit to the main operation circuit as a correction signal.

As such, according to the invention, even if coal properties change, the operation of making the deviation between the coal output pattern during current operation and the targeted preset standard coal output pattern small is performed, so that it is possible to perform stable mill coal output control, and stable response control becomes possible.

Additionally, the additional control unit includes a coal output estimation unit estimating the coal output of pulverized coal by using at least any of detection data from the coal pulverizer, detection data from the boiler, and detection data from the power generator.

In the coal output estimation unit, any of during settlement or during change of the coal pulverizer is selected, and the correction signal is calculated in the additional control unit on the basis of a coal output estimate on the selected side.

At this time, the detection data input to the main operation circuit and the command signal associated with the coal feed rate include the following.

First, the detection data input to the main operation circuit is a power generator output command value and a main steam pressure deviation or a main steam temperature deviation, and the command signal associated with the coal feed rate is a coal feed rate command value.

Second, the detection data input to the main operation circuit is a coal feed rate command value and a coal pulverizer current value, and the command signal associated with the coal feed rate is a rotation frequency command value of the coal pulverizer.

Third, the detection data input to the main operation circuit is a coal feed rate command value and a roll lift pressure value, and the command signal associated with the coal feed rate is a pressure setting value of an oil pressure load device provided in the coal pulverizer.

Additionally, it is preferable that the control device further includes a correction circuit which corrects the preset standard coal output pattern by coal properties, such as coal calorific power and coal moisture percentage.

Effect of the Invention

As described above, according to the invention, even if coal properties change, the operation of making the deviation between the coal output pattern during current operation and the targeted preset standard coal output pattern small is performed, so that it is possible to perform stable mill coal output control, and stable response control becomes possible.

MODE FOR CARRYING OUT THE INVENTION

Preferred embodiments of the invention will be illustratively described below in detail with reference to the drawings. Here, the dimensions, materials, shapes, relative arrangements, etc. of component parts described in these embodiments are not meant to limit the scope of the invention, but are merely simple explanatory examples, especially where there is no specific description of limitations.

First, an example of a coal pulverizer (roller mill) used in this embodiment will be described with reference to FIG. 6.

Figure 6:
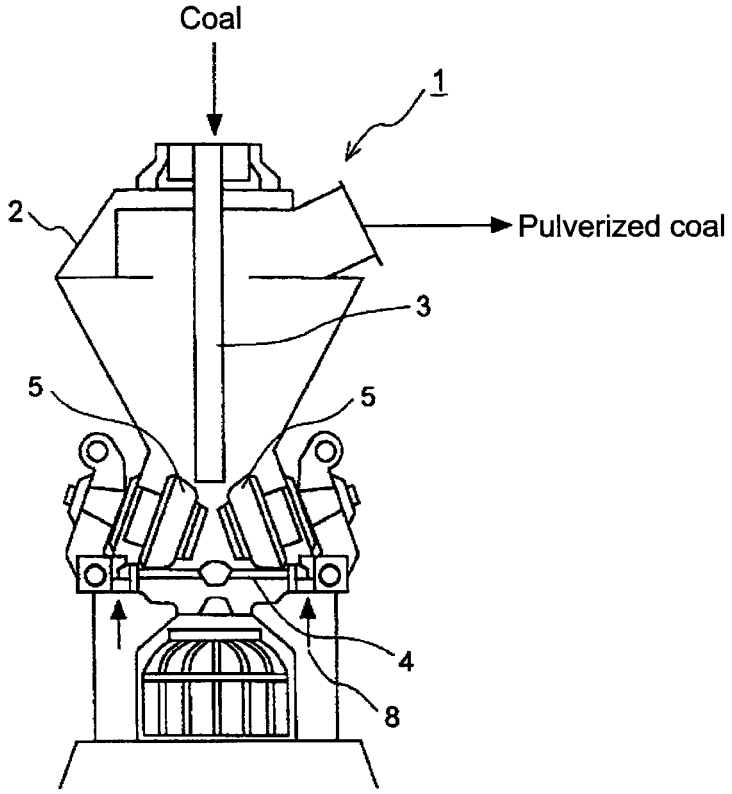
FIG. 6 is a schematic configuration diagram of a coal pulverizer to which the invention is applied.
Figure 7:
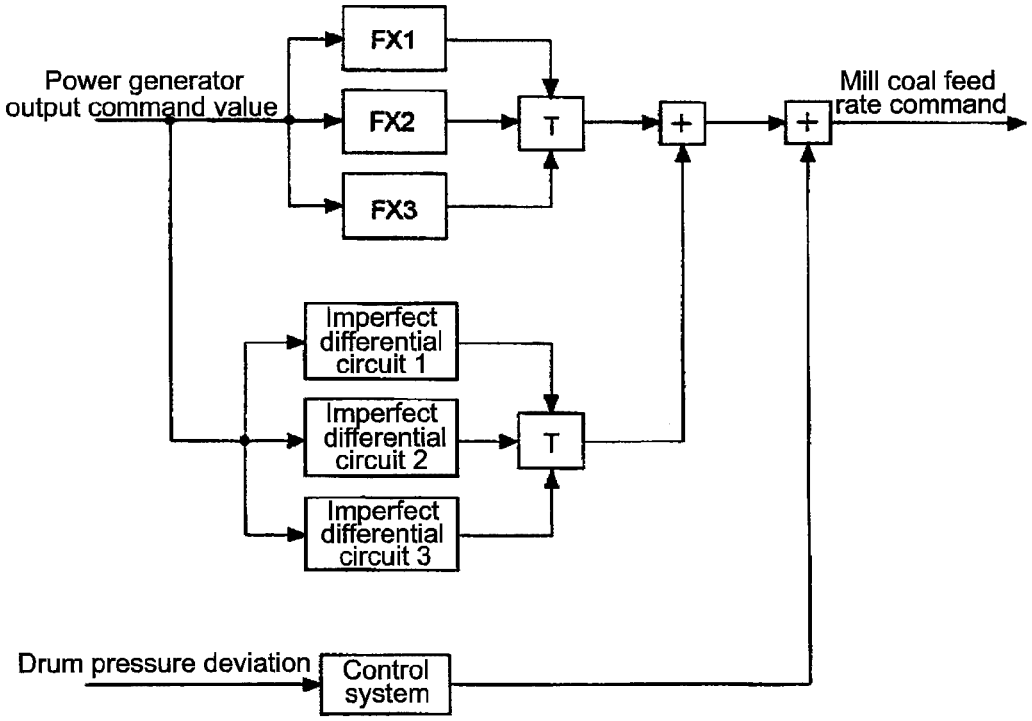
FIG. 7 is a block diagram illustrating the configuration of a conventional control device including a circuit which calculates a mill coal feed rate command.
Figure 8:
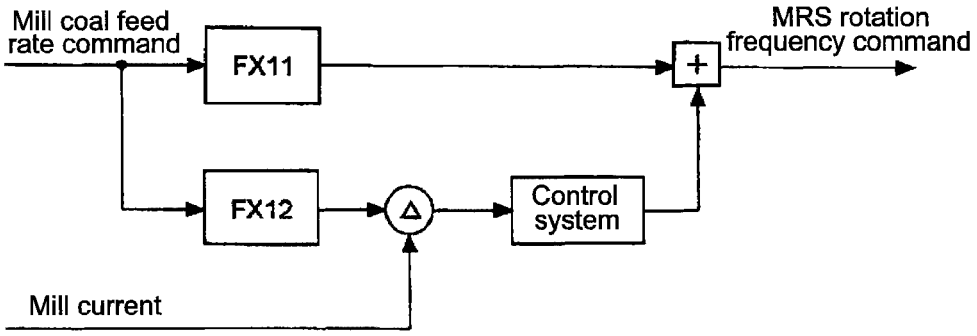
FIG. 8 is a block diagram illustrating the configuration of a conventional control device including a circuit which calculates an MRS rotation frequency command.
Figure 9:
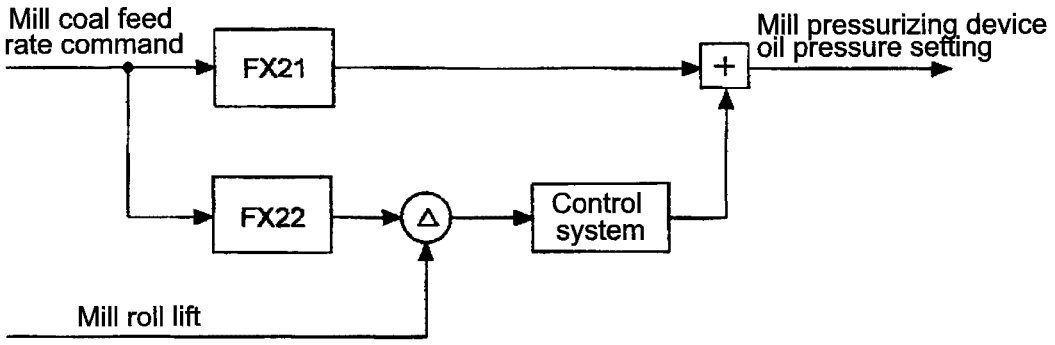
FIG. 9 is a block diagram illustrating the configuration of a conventional control device including a circuit which calculates a mill pressurizing device oil pressure setting value.

As shown in FIG. 6, the roller mill 1 includes a substantially hermetically sealed casing 2, and individual components provided within the casing 2. Coal supply means 3 which leads to the inside of a casing, a rotary table 4 provided below an input port of the coal supply means 3, a plurality of rollers 5 which slides on the top face of the rotary table 4, and a fine powder outlet pipe 6 provided on the top face of the casing 2 are housed within the casing 2.

In the roller mill 1, the rotary table 4 is rotationally driven by a drive mechanism (not shown), and the rollers 5 are pushed against the top face of the rotary table 4, and slide with the rotation of the rotary table 4. Coal is supplied to the top face of the rotary table 4 from the coal supply means 3, and is sandwiched, crushed, and pulverized between the rotary table 4 and the rollers 5 on this top face.

Meanwhile, the pulverized coal is discharged after the pulverized coal is classified by carrying air 8 introduced from a lower part of the casing 2.

This embodiment relates to a control device which appropriately controls the coal feed rate of the coal pulverizer 1 as described above, and concrete configurations of the control device will be shown in the following first to fifth embodiments.

First Embodiment

Figure 1:
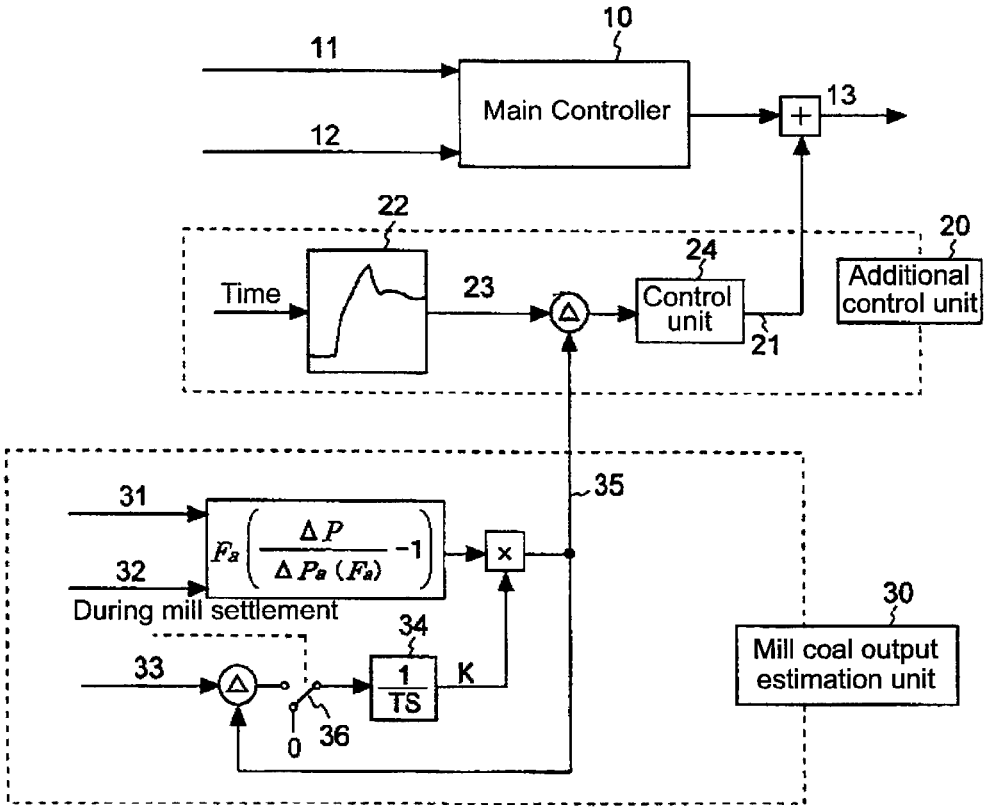
FIG. 1 is a block diagram illustrating the configuration of a control device according to a first embodiment of the invention.

FIG. 1 is a block diagram illustrating the configuration of a control device according to a first embodiment of the invention. This invention is adapted to add an output signal of a control system using the deviation of a standard mill coal output pattern and a mill coal output pattern during current operation to a primitive signal of a conventional control system as a correction signal, thereby performing mill coal output control more stably, and the first embodiment is configured to use a coal feed rate command value as a command signal associated with a coal feed rate.

In FIG. 1, the control device of the first embodiment includes a main controller 10 that is a conventional control system, an additional control unit 20, and a mill coal output estimation unit 30.

The mill coal output estimation unit 30 measures a mill furnace differential pressure ($\Delta P$) 31 and an air flow rate (Fa) 32 that are existing detecting elements, and estimates a mill coal output. The mill furnace differential pressure 31 is a pressure loss of a solid-gas mixed fluid, and it is possible to obtain an approximate value of the coal output using the following Expression (1) by the mill furnace differential pressure along with the air flow rate 32.

$$Fc=KFa(\Delta P/\Delta Pa(Fa)-1) \quad (1)$$

Here, Fc is a coal output, K is a coefficient, and ΔPa is a mill furnace differential pressure when a fluid is only air, and is the function of an air flow rate. The relationship between the air flow rate Fa and the mill furnace differential pressure ΔPa when a fluid is only air is determined during a test run, or the like. Accordingly, if the coefficient K is obtained, it is possible to obtain a mill coal output estimate 35.

It is believed that the coefficient K varies depending on the difference of fineness based on the difference of moisture percentage or the difference of HGI or depending on the humidity of air. Although the coefficient K is a resistance coefficient of a mill coal feed pipe, and it is difficult to determine the coefficient theoretically, during stable operation of the mill (during perfect settlement), it is possible to calculate the coefficient K as the mill coal feed rate and the coal output necessarily coincide with each other.

A deviation signal between the coal feed rate 33 and the coal output estimate 35, and a zero signal are input to a switch 36 of the coal output estimation unit 30, and the latter is output during a mill change, and the former is output during mill settlement. An output signal of the switch 36 is input to an integrator 34 where an integral action is slowly performed. The output of the integrator 34 gives the coefficient K.

Since the coal output is delayed behind the coal feed rate during a mill change, neither coincide with each other. Accordingly, the operation of the coefficient K is stopped with the input of the integrator 34 as zero.

Although the operation of the coefficient K is performed only during mill settlement, a signal during the mill settlement is defined after a certain time period, etc., after the fluctuation of the coal feed rate or other state quantities around the mill is settled.

Since the coefficient K is always updated during mill settlement by the above actions, the approximate value of the mill coal output can be estimated even when the type of coal changes or even when the same charcoal is used but the moisture percentage changes.

The function generator 22 of the additional control unit 20 is a function which gives a targeted mill coal output pattern 23. The difference between this pattern and a mill coal output estimation signal is input to the control unit 24. The control unit 24 is, for example, a proportional controller, etc. An output signal of the additional control unit 20 is added to a conventional control signal, and serves as a coal feed rate command 13.

The time pattern of a targeted mill coal output is determined as the most desirable pattern as a boiler response for a certain representative coal (standard coal) during a test run.

Even if coal properties change in this way, the operation of making the deviation between the mill coal output pattern during current operation and the targeted mill coal output pattern small is performed, so that it is possible to perform stable mill coal output control, and excellent response control becomes possible.

In addition, in the first embodiment, although the targeted coal output pattern is expressed by one function, in practice, the pattern of a power generator output change to be employed, for example, a function corresponding to the load, change width, change rate, etc. before the start of a change, or a logic having a function equivalent to a function generator may be used.

Second Embodiment

Figure 2:
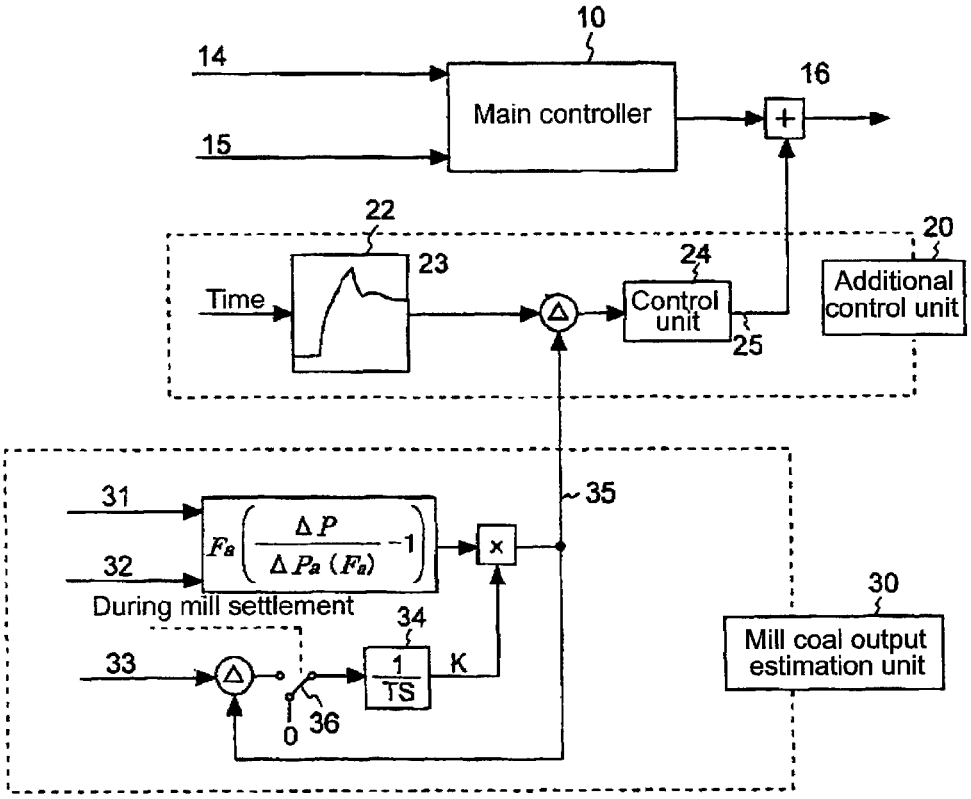
FIG. 2 is a block diagram illustrating the configuration of a control device according to a second embodiment of the invention.

FIG. 2 is a block diagram illustrating the configuration of a control device according to a second embodiment of the invention.

The second embodiment is configured to use the MRS rotation frequency of the coal pulverizer as a command signal associated with the coal feed rate.

In FIG. 2, the control device of the second embodiment includes a main controller 10 that is a conventional control system, an additional control unit 20, and a mill coal output estimation unit 30.

The mill coal output estimation unit 30 and the additional control unit 20 are the same as those of the first embodiment.

A mill coal feed rate command 14 and a mill current 15 are input to the main controller 10, and arithmetic processing is performed on the basis of the input, thereby obtaining an MRS rotation frequency command value 16. At this time, an MRS rotation frequency command correction value 25 obtained by the mill coal output estimation unit 30 and the additional control unit 20 is added to the conventional MRS rotation frequency command value. The control unit 24 is, for example, a proportional controller, etc.

In this second embodiment, the MRS rotation frequency of the coal pulverizer is used as a command signal associated with the coal feed rate. In this case, since the MRS rotation frequency is one of the factors which change the mill coal output, the command signal associated with the coal feed rate can be simply obtained by operation by using this rotation frequency.

Third Embodiment

Figure 3:
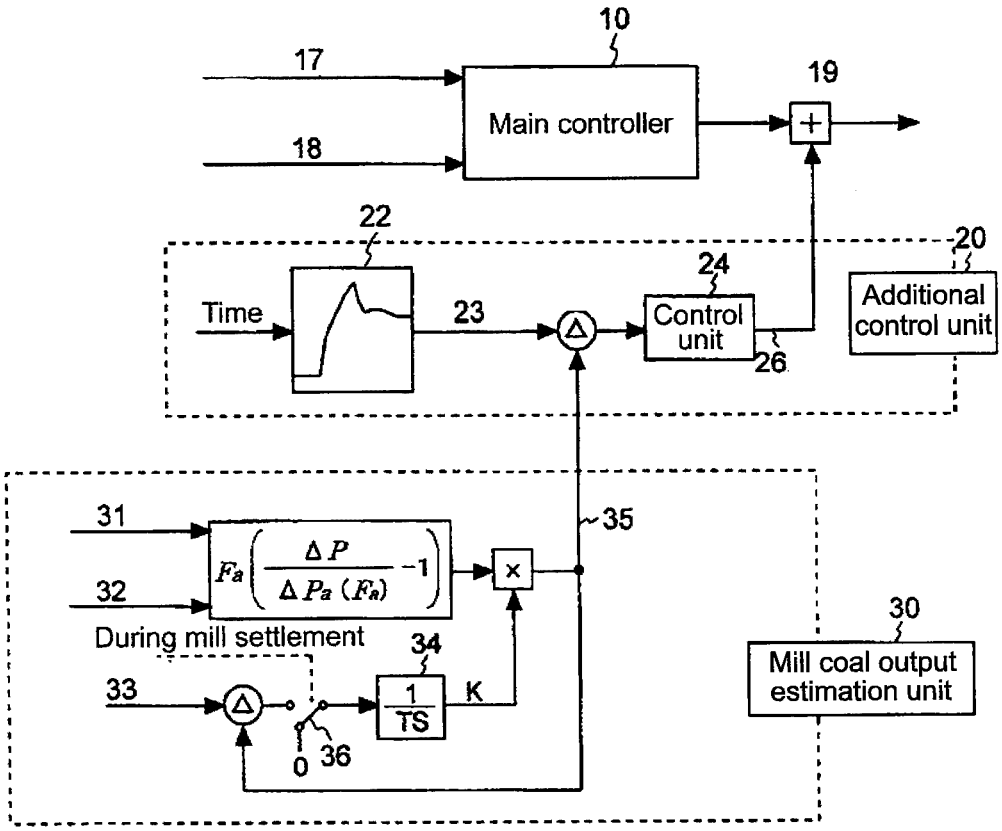
FIG. 3 is a block diagram illustrating the configuration of a control device according to a third embodiment of the invention.

FIG. 3 is a block diagram illustrating the configuration of a control device according to a third embodiment of the invention.

The third embodiment is configured to use the load pressure of an oil pressure load device provided in the coal pulverizer as a command signal associated with the coal feed rate. The load pressure represents a pressure applied to the rollers in the coal pulverizer.

In FIG. 3, the control device of the third embodiment includes a main controller 10 that is a conventional control system, an additional control unit 20, and a mill coal output estimation unit 30.

The mill coal output estimation unit 30 and the additional control unit 20 are the same as those of the first embodiment.

A mill coal feed rate command 17 and a roll lift 18 are input to the main controller 10, and arithmetic processing is performed on the basis of the input, thereby obtaining an oil pressure load device pressure setting value 19. At this time, an oil pressure load device pressure setting value correction value 26 obtained by the mill coal output estimation unit 30 and the additional control unit 20 is added to the conventional MRS rotation frequency command value. The control unit 24 is, for example, a proportional controller, etc.

In this third embodiment, the load pressure of the oil pressure load device provided in the coal pulverizer is used as a command signal associated with the coal feed rate. In this case, since the load pressure is one of the factors which change the mill coal output, the command signal associated with the coal feed rate can be simply obtained by an operation using this load pressure.

Fourth Embodiment

Figure 4:
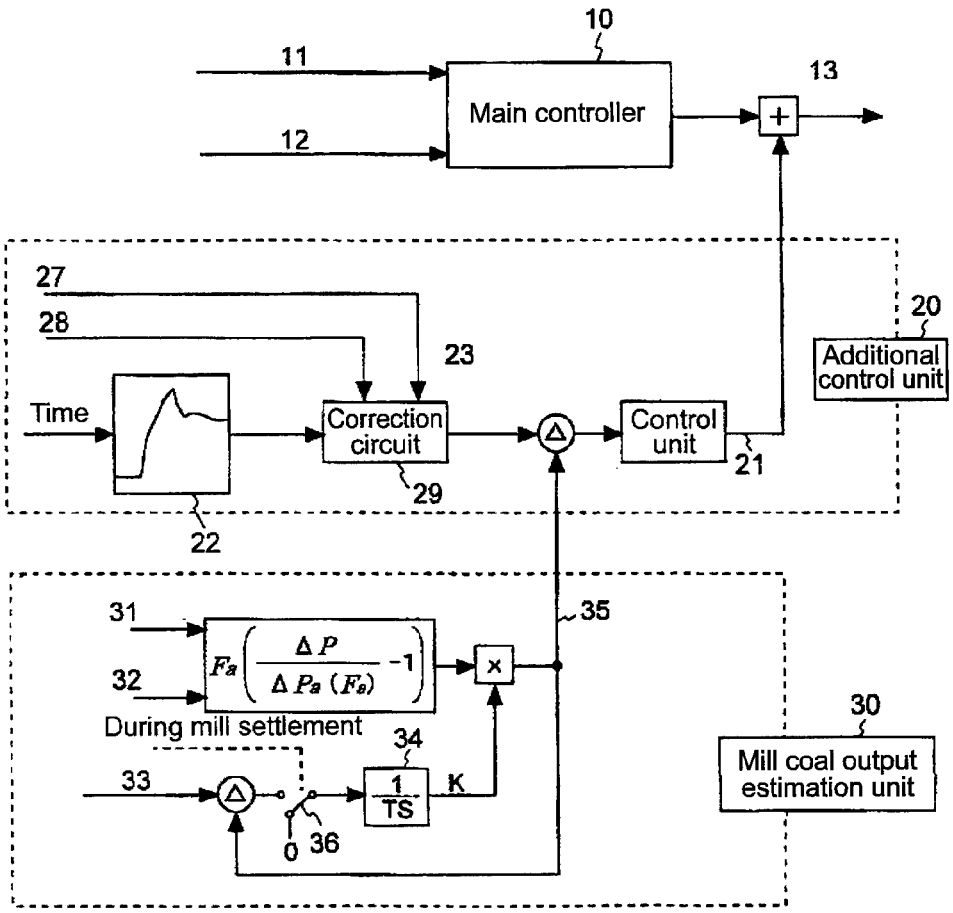
FIG. 4 is a block diagram illustrating the configuration of a control device according to a fourth embodiment of the invention.

FIG. 4 is a block diagram illustrating the configuration of a control device according to a fourth embodiment of the invention.

Although it is possible to apply this fourth embodiment to the above-described first to third embodiments, a case where the fourth embodiment is applied to the first embodiment will be shown as an example.

Here, the fourth embodiment is configured to have a correction circuit which corrects a targeted coal output pattern by coal properties, such as coal calorific power and coal moisture percentage.

As shown in FIG. 4, the correction circuit 29 performs the correction processing of multiplying a target pattern by the ratio of the calorific power of coal when the targeted coal output pattern 23 is determined and a current calorific power of the coal.

By further correcting a correction signal according to coal properties in this way, it is possible to cope with two or more kinds of coal having different properties, and it is possible to perform high-precision coal output control.

Fifth Embodiment

Figure 5:
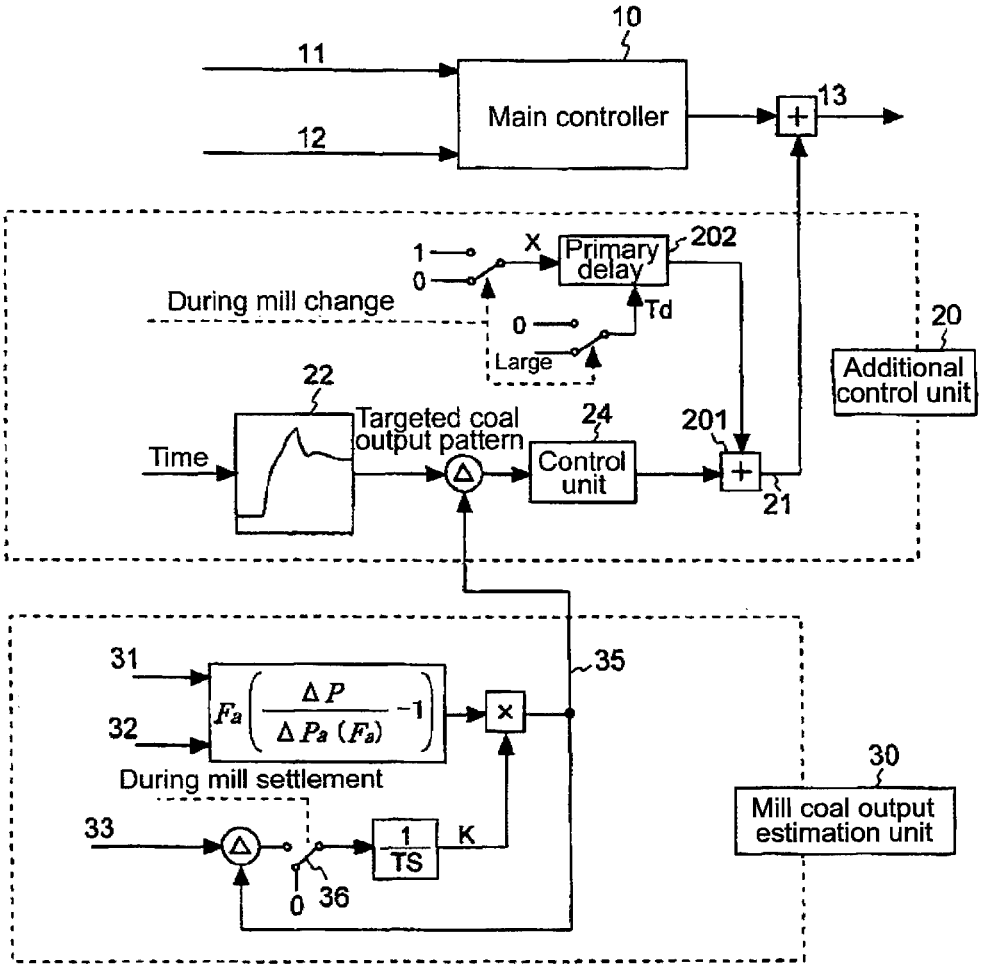
FIG. 5 is a block diagram illustrating the configuration of a control device according to a fifth embodiment of the invention.

FIG. 5 is a block diagram illustrating the configuration of a control device according to a fifth embodiment of the invention.

Although it is possible to apply this fifth embodiment to the above-described first to fourth embodiments, a case where the fifth embodiment is applied to the first embodiment will be shown as an example.

Here, a correction signal is created for the purpose of obtaining coal output characteristics as close to the targeted coal output pattern as possible, regardless of coal properties. The improvement in these coal output characteristics is required only during a mill change (especially immediately after start of a change), and is not required during mill settlement. It is also believed that continuing a corrective action even during mill settlement is able to actually disturb conventional control depending on the case. This is avoided in the fifth embodiment.

As shown in FIG. 5, an output part of the control unit 24 is provided with a multiplier 201. Another input of the multiplier 201 is an output signal of a primary delay circuit 202. During a mill change, 1 is input as the input x of the primary delay circuit 202, and 0 or approximate 0 is input as a time constant Td. When during the mill change is OFF, 0 is input as x and a large value is input as Td.

When a mill change is started by the above circuit, a coal feed rate correction command value 21 directly serves as an output of the control unit 24, and when the mill change ends, the coal feed rate command correction is slowly set to zero. Setting coal feed rate command correction to zero is slowly performed in order to avoid a sudden change of the coal feed rate correction command value 21.

This makes it possible to obtain coal output characteristics close to the targeted coal output pattern, regardless of coal properties.

INDUSTRIAL APPLICABILITY

Since the control device of the coal pulverizer of the invention is able to estimate the delivery rate of a fine powder fuel with a precision suited for a purpose, is able to perform stable control, and is able to be applied to various kinds of solid fuels, it is possible to suitably use the control device for a coal burning boiler, etc.

The invention claimed is:

1. A control device of a coal pulverizer which pulverizes coal by the coal pulverizer and estimates coal output by which the pulverized coal is output to a boiler, the control device comprising:

a main operation circuit configured to calculate a command signal associated with a coal feed rate on the basis of detection data from a boiler or a power generator connected to the boiler; and an additional control unit configured to calculate a deviation between a standard coal output pattern preset in the coal pulverizer and a current coal output pattern of the coal pulverizing operation, and to generate a correction signal based on the deviation, the correction signal being used to correct the command signal, wherein the additional control unit is configured to send the correction signal to the main operation circuit during the coal pulverizing operation, wherein the correction signal is added to the command signal so as to correct the command signal, and wherein the additional control unit comprises a coal output estimation unit configured to estimate the coal output of pulverized coal by using at least any of detection data from the coal pulverizer, detection data from the boiler, and detection data from the power generator.

2. The control device of a coal pulverizer according to claim 1, wherein in the coal output estimation unit, any one of during settlement or during change of the coal pulverizer is selected, and the correction signal is calculated in the additional control unit on the basis of a coal output estimate on the selected side.

3. The control device of a coal pulverizer according to claim 1, wherein the detection data input to the main operation circuit is a power generator output command value and a main steam pressure deviation or a main steam temperature deviation, and the command signal associated with the coal feed rate is a coal feed rate command value.

4. The control device of a coal pulverizer according to claim 1, wherein the detection data input to the main operation circuit is a coal feed rate command value and a coal pulverizer current value, and the command signal associated with the coal feed rate is a rotation frequency command value of the coal pulverizer.

5. The control device of a coal pulverizer according to claim 1, wherein the detection data input to the main operation circuit is a coal feed rate command value and a roll lift pressure value, and the command signal associated with the coal feed rate is a pressure setting value of an oil pressure load device provided in the coal pulverizer.

6. The control device of a coal pulverizer according to claim 1, further comprising a correction circuit adapted to correct the preset standard coal output pattern based on a coal property.

7. The control device of a coal pulverizer according to claim 6, wherein said coal property is a coal calorific power.

8. The control device of a coal pulverizer according to claim 6, wherein said coal property is a coal moisture percentage.

9. The control device of a coal pulverizer according to claim 1, wherein the coal output estimation unit is configured to calculate a coal output estimate based on a mill furnace differential pressure and a flow rate of pulverized coal carrying air.

10. The control device of a coal pulverizer according to claim 9, wherein the coal output estimation unit is configured to correct the coal output estimate based on a deviation between the coal output estimate and the coal feed rate during settlement of the coal pulverizer.

* * * * *